US005314358A

United States Patent [19]

Klemmer et al.

[11] Patent Number: 5,314,358

[45] Date of Patent: May 24, 1994

[54] TERMINAL POSITION ASSURANCE SYSTEM FOR ELECTRICAL CONNECTORS

[75] Inventors: Robert A. Klemmer, Wheaton; Ronald S. Krzeczowski, Lemont; Kirk B. Peloza, Naperville; Russell E. Wende, Oak Lawn, all of Ill.

[73] Assignee: Molex Incorporated, Lisle, Ill.

[21] Appl. No.: 42,312

[22] Filed: Apr. 2, 1993

[51] Int. Cl.[5] ..... H01R 13/415

[52] U.S. Cl. ..... 439/741; 29/844

[58] Field of Search ..... 439/741, 870; 29/844

[56] References Cited

U.S. PATENT DOCUMENTS 3,178,672 4/1965 Batcheller ..... 439/870
4,359,258 11/1982 Palecek et al. ..... 339/176
5,147,228 9/1992 Miller et al. ..... 439/741

FOREIGN PATENT DOCUMENTS 147749 4/1981 Fed. Rep. of Germany .

*Primary Examiner*—Eugene F. Desmond
*Attorney, Agent, or Firm*—Stephen Z. Weiss

[57] ABSTRACT

A terminal position assurance system is provided for an electrical connector which includes a dielectric housing having a terminal-receiving passage into which a terminal is inserted in an insertion direction to a fully inserted position. A latch surface is formed in the housing adjacent the passage and facing in the insertion direction. A bendable tab is provided on the terminal and is adapted to be bent against the latch surface. The bendable tab is structured to be bent about an axis generally parallel to the insertion direction to move an edge portion of the tab to a position over the latch surface when the terminal is in its fully inserted position.

9 Claims, 3 Drawing Sheets

TERMINAL POSITION ASSURANCE SYSTEM FOR ELECTRICAL CONNECTORS

FIELD OF THE INVENTION

This invention generally relates to the art of electrical connectors and, particularly, to a terminal position assurance system for electrical connectors.

BACKGROUND OF THE INVENTION

Terminal position assurance systems heretofore employed in electrical connectors often require the use of a separate component to provide the terminal positioning assurance. In other words, after terminals are inserted into terminal-receiving passages in a connector housing, a separate component is inserted into an opening or openings in the housing which communicates with the terminal-receiving passages. In essence, this separate component provides a secondary lock on the terminals as well as some indication that all of the terminals are in their proper positions.

Problems are encountered with the use of separate terminal position assurance components in that they are more susceptible to leakage or arc tracking. In addition, because of the additional separate components, a user of such systems must maintain an inventory of not only the connector housings and the terminals, but also the separate terminal position assurance or locking components. The potential of leakage or arc tracking is created because the separate components require an opening in the housing for access to a portion of a terminal.

This invention is directed to solving the above problems and providing an improved terminal position assurance system which does not require separate locking components and, in fact, uses an integral portion of each terminal as a secondary locking feature which provides the terminal position assurance system. The integral portion herein is provided by a bendable tab.

Bendable tabs have been used heretofore for locking terminals in respective terminal-receiving passages within connector housings. However, such prior art bendable tabs have not been capable of providing a terminal positioning assurance system.

More particularly, the bendable tabs of the prior art are generally planar and are bent about axes or fold lines which are generally perpendicular to the insertion direction of the terminals. Such bendable tabs are bent to overlie locking surfaces of the connector housing adjacent the terminal-receiving passages. In other words, the tabs are bent about axes or fold lines generally parallel to such surfaces. Consequently, a particular terminal might not be fully inserted into its respective terminal-receiving passage, but the bendable tab still is capable of being bent to overlie the locking surface, notwithstanding the fact that the terminal is not properly positioned in the housing.

The present invention utilizes a simple bendable tab which not only can be considered a terminal locking feature but also provides a terminal-position assurance means for the terminal.

SUMMARY OF THE INVENTION

An object, therefore, of the invention is to provide a new and improved terminal position assurance system of the character described.

In the exemplary embodiment of the invention, the system is used in an electrical connector which includes a dielectric housing having a wall with a terminal-receiving passage therethrough. The wall defines first and second surfaces. A terminal is adapted to be received in the passage with a mating portion on one side of the wall and a terminating portion on the other side of the wall. Stop means are provided on the terminal for engaging the first surface of the wall to prevent the terminal from passing completely through the passage and to define a fully inserted position of the terminal. A bendable tab is provided on the terminal and is adapted to be bent against the second surface of the wall when the terminal is inserted into the passage.

The invention contemplates that the bendable tab be structured to be bent about an axis perpendicular to the second surface of the wall and be positioned over the second surface when the terminal is fully positioned in the passage.

More particularly, the second surface of the wall is generally flat and the tab is generally planar. The tab has an edge generally perpendicular to its bend axis, with the edge adapted for lockingly engaging the second surface when the tab is bent about the axis. Therefore, if the terminal is not inserted to its fully inserted position, the tab cannot be bent about the axis, thereby indicating that the terminal has not been fully inserted into the passage.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
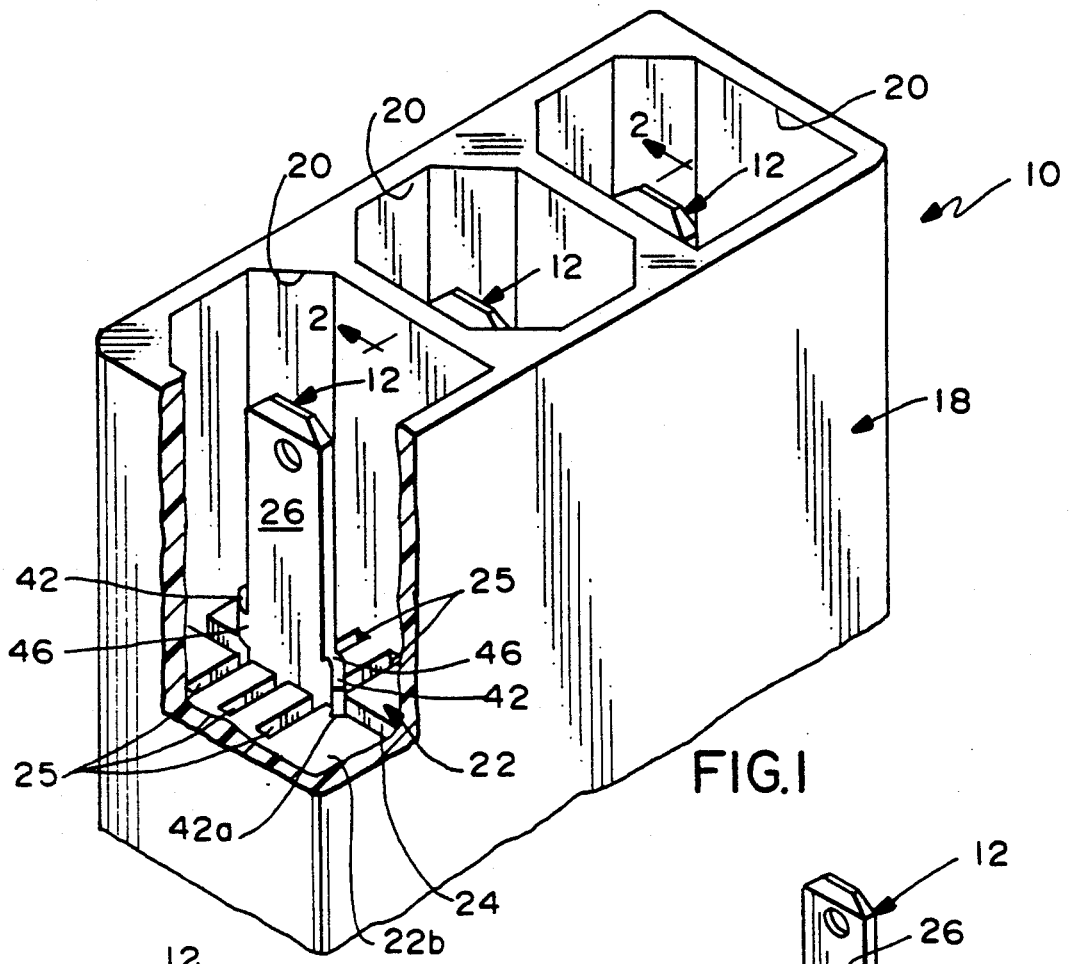
FIG. 1 is a perspective view, partially cut away, of an electrical connector mounting a plurality of male terminals and embodying the concepts of the invention.
Figure 2:
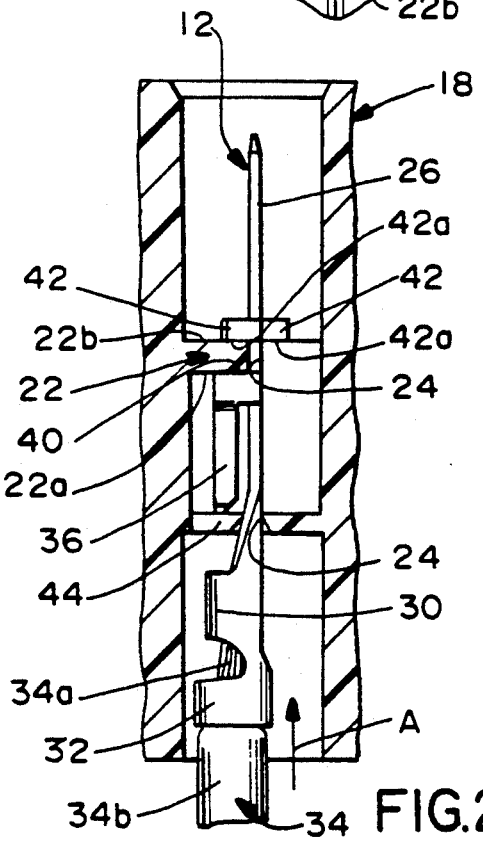
FIG. 2 is a fragmented vertical section taken generally along line 2—2 of FIG. 1.
Figure 3:
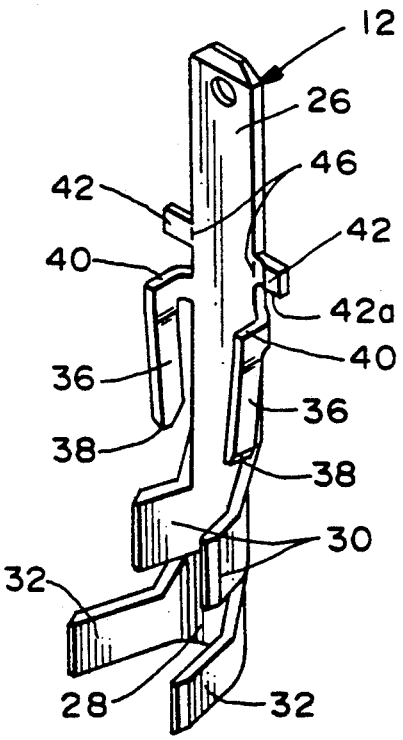
FIG. 3 is a perspective view of one of the male terminals of the connector of FIG. 1.
Figure 4:
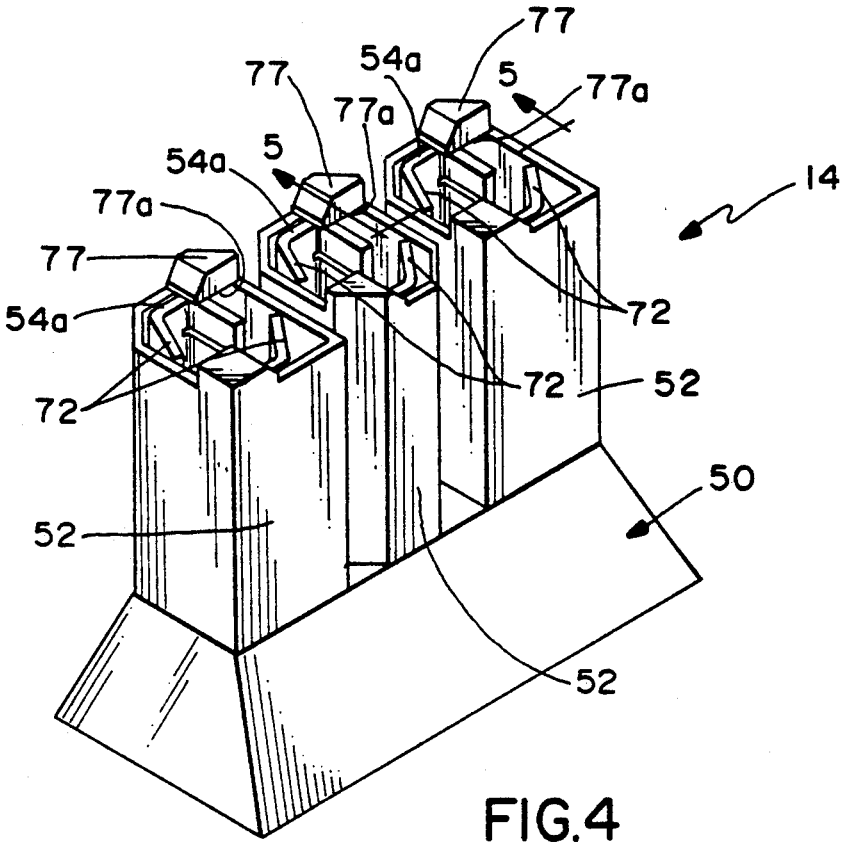
FIG. 4 is a perspective view of an electrical connector employing a plurality of female terminals and embodying the concepts of the invention.
Figure 5:
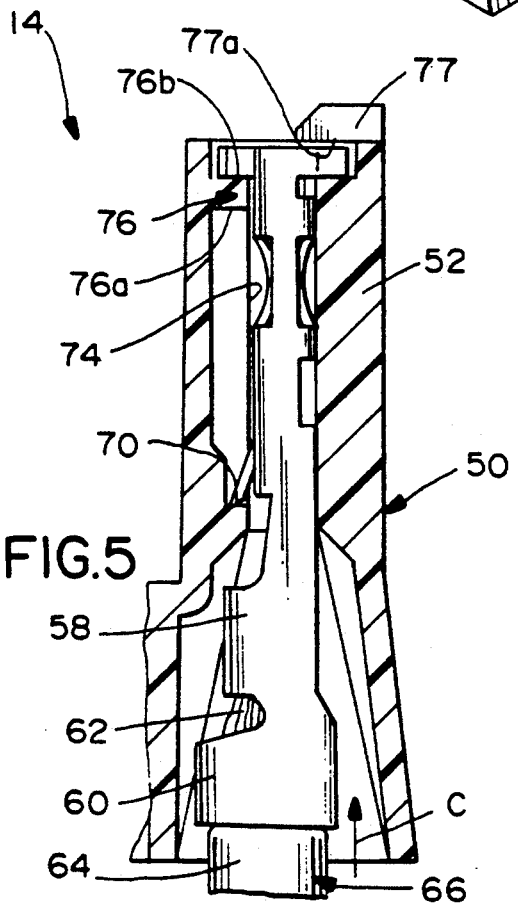
FIG. 5 is a fragmented vertical section taken generally along line 5—5 of FIG. 4.
Figure 6:
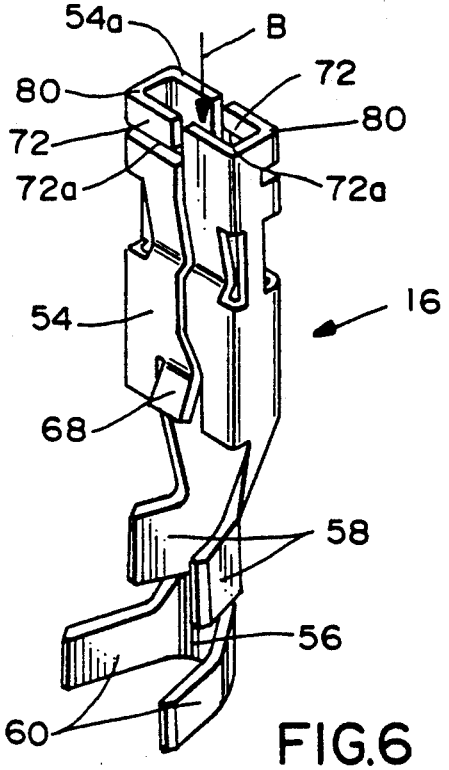
FIG. 6 is a perspective view of one of the female terminals of the connector of FIG. 4.

Referring to the drawings in greater detail, FIGS. 1-3 show an electrical connector, generally designated 10, which mounts a plurality of male terminals, generally designated 12; and FIGS. 4-6 show an electrical connector, generally designated 14, which mounts a plurality of female terminals, generally designated 16. Each connector 10 and 14, along with their terminals 12 and 16, respectively, embodies the terminal positioning assurance system of the invention.

More particularly, connector 10 (FIGS. 1-2) includes a dielectric housing, generally designated 18, having a plurality of receptacles 20 for matingly receiving a plurality of silos of a complementary mating connector, such as connector 14 in FIGS. 4 and 5. The base of each receptacle 20 is defined by a wall, generally designated 22, defining first and second surfaces 22*a* (FIG. 2) and 22*b*. The wall has a terminal-receiving passage 24 therethrough. Passages 25 (FIG. 1) in wall 22 simply are core-out passages used in molding housing 18.

Each male terminal 12 includes a flat or generally planar blade-like mating portion 26 and a terminating portion 28. The mating portion is adapted for mating with a female terminal such as female terminal 16 in FIG. 6. Terminating portion 28 includes two pairs of crimp arms 30 and 32 for termination to an electrical wire, such as an insulated conductor, generally designated 34 in FIG. 2. Crimp arms 30 are crimped onto a conductor core 34*a*, whereas crimp arms 32 are crimped onto the outer cladding or insulation 34*b* of the insulated conductor.

Male terminal 12 may be stamped and formed of sheet metal material and includes a pair of primary locking arms 36 which are cantilevered to define resilient distal ends 38 and rigid stop shoulders 40, for purposes described hereinafter. In addition, a pair of bendable tabs 42 project outwardly of terminal blade 26 generally coplanar therewith in the initial condition of the terminal shown in FIG. 3. These blades can provide a secondary lock for the terminal, and the bendable tabs are provided as terminal position assurance devices as described herein-after.

After crimp arms 30 and 32 are crimped to terminate each terminal 12 to an insulated conductor 34, the terminal is inserted into housing 18 in the direction of arrow "A" (FIG. 2). The fully inserted position of the terminal is shown in FIG. 2. It can be seen that stop shoulders 40 have engaged against first surface 22*a* of wall 22. In addition, primary locking arms 36 have snapped behind interior partitions 44 to prevent the terminal from backing out or away from its fully inserted position. When in such a fully inserted position, bendable tabs 42 can be used as a terminal position assurance system.

More particularly, as seen best in FIG. 1, but also in FIG. 2, tabs 42 have been bent from their first or original positions shown in FIG. 3 generally coplanar with terminal blade 26, to bent positions whereat the tabs are positioned over second surface 22*b* of wall 24. The tabs are bent about axes located generally at 46 in FIG. 1. These axes are generally parallel to the insertion direction of the terminals as indicated by arrow "A" (FIG. 2), or the axes can be considered to extend generally perpendicular to surface 22*b*. Therefore, an edge 42*a* of each tab moves in a path over the top of surface 22*b*.

If one of male terminals 12 is not fully positioned as shown, any attempt to bend its tabs 42 about axes 46 would not be possible, because edges 42*a* of the tabs will not have cleared surface 22*b* of wall 22. This inability to bend the tabs gives a clear indication that the terminal is not in its fully inserted position.

Connector 14 and female terminals 16 in FIGS 4-6 incorporate a similar "bendable tab" terminal position assurance system as described above in relation to connector 10 and male terminals 12 in FIGS. 1-3. Specifically, connector 14 includes a dielectric housing, generally designated 50, defining a plurality of silos 52 for mating with a plurality of receptacles of a complementary connector, such as receptacles 20 of connector 18 (FIG. 1). One of the female terminals 16 is mounted within each silo 52.

As best in seen in FIG. 6, each female terminal 16 includes a generally hollow mating portion 54 for mating with a male terminal, such as blade portion 26 of male terminal 12 inserted into mating female portion 54 in the direction of arrow "B". Each female terminal 16 includes a terminating portion 56 having two pairs of crimp arms 58 and 60 for crimping onto a conductor core 62 and an insulating cladding, respectively, of an insulated conductor, generally designated 66. Like male terminal 12, female terminal 16 is fabricated of stamped and formed sheet metal material, and a primary locking arm 68 is bent or formed outwardly of the terminal for snapping behind a locking shoulder 70 (FIG. 5) of housing 50 when the terminal is in its fully inserted position within its respective silo 52. As will be described in greater detail hereinafter, the terminal also includes a pair of bendable tabs 72, having lower edges 72*a*, to provide a terminal position assurance system for connector 14.

Each female terminal 16 is inserted into a passage 74 (FIG. 5) in housing 50 and a respective one of the silos 52, in the direction of arrow "C". The passage includes a wall, generally designated 76, which defines a first surface 76*a* and a second surface 76*b*. Stop means are provided by corner bosses 77 of silos 52, the bosses having interior stop surfaces 77*a*. In the fully inserted positions of female terminals 16, the ends 54*a* of the mating portions 54 of the terminals abut against stop surfaces 77*a* of bosses 77.

Similar to the terminal position assurance system described above in relation to connector 10 and male terminals 12 in FIGS. 1-3, when each female terminal 16 is inserted to its fully inserted position as shown in FIG. 5, edges 72*a* of bendable tabs 72 are clear of second surface 76*b* of wall 76 within the respective passage 74 of the housing. Tabs 72 then can be bent about axes 80 (FIG. 6) generally parallel to the insertion direction "C" of the terminal, whereby the bendable tabs are positioned over the second surface 76*b* of wall 76. In other words, the tabs are bendable about axes 80 which extend generally perpendicular to surface 76*b*. Should the terminal not be fully inserted, the bendable tabs will not clear wall 76 and cannot be bent to the positions shown in FIGS. 4 and 5, which gives an indication that the terminal is not properly positioned.

Figure 7:
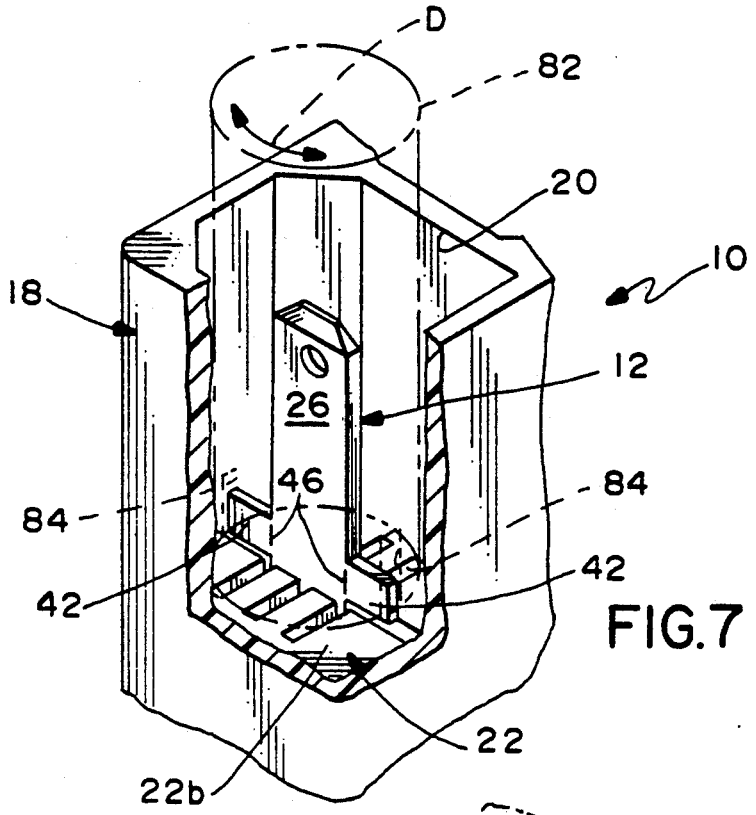
FIG. 7 is a fragmented perspective view of one of the male terminals of the connector in FIG. 1, with the bendable tabs in position prior to bending, along with an appropriate tool shown in phantom for effecting bending of the tabs.
Figure 8:
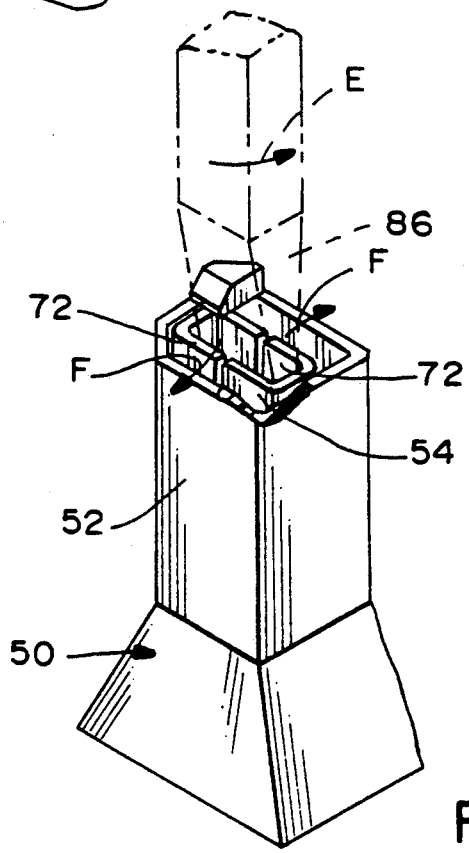
FIG. 8 is a view similar to that of FIG. 7, but showing in phantom an appropriate tool for bending the tabs of one of the female terminals of the connector shown in FIG. 4.

FIGS. 7 and 8 show various types of tools for bending the terminal position assurance tabs of male terminals 12 (FIG. 7) and female terminals 16 (FIG. 8) when the terminals are in their fully inserted positions.

More particularly, referring to FIG. 7, a generally cylindrical tool 82 has a pair of slots or notches 84 in its lower peripheral edge. The notches are dimensioned for embracing bendable tabs 42 of male terminal 12, as the tool is inserted downwardly into receptacle 20 of connector housing 18. With the notches embracing the bendable tabs, the tool can be rotated in either direction as indicated by double-headed arrow "D" to bend the tabs about axes 46 so that the tabs are positioned over surface 22*b* of wall 22.

Referring to FIG. 8, a tool 86 is shown in phantom and is configured as a blade, such as a blade of a small screw driver. The tool is inserted into mating portion 54 of female terminal 16 similar to the insertion of a male terminal as indicated by arrow "B" in FIG. 6. Once inserted, the tool is rotated in the direction of arrow "E" to bend tabs 72 outwardly in the direction of arrows "F",whereupon the tabs will be bent from the positions shown in FIG. 8 to the positions shown in FIG. 4, thereby indicating that the particular female terminal has been inserted to its proper fully inserted position. Again, if any given female terminal is not fully inserted or properly positioned, tool 86 cannot bend the tabs because the tabs will not clear wall 76 (FIG. 5).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim

1. A terminal position assurance system in an electrical connector which includes a dielectric housing having a wall with a terminal-receiving passage therethrough, the wall defining first and second surfaces, a terminal adapted to be received in the passage with a mating portion on one side of the wall and a terminating portion on the other side of the wall, stop means on the terminal for engaging a stop surface of the housing to prevent the terminal from passing completely through the passage in an insertion direction toward the first surface and to define a fully inserted position of the terminal, and a bendable tab on the terminal and adapted to be bent against the second surface of the wall when the terminal is inserted into the passage, wherein the improvement comprises said mating terminal portion having a forward end, said stop means located at said forward end and said bendable tab located at said forward end being structured to be bent about an axis perpendicular to the second surface of the wall and be positioned over the second surface when the terminal is fully positioned in the passage.

2. The terminal position assurance system as set forth in claim 1, wherein said second surface is generally flat and said tab is generally planar.

3. The terminal position assurance system as set forth in claim 2, wherein said tab had an edge generally perpendicular to said axis and adapted for lockingly engaging the second surface when the tab is bent about the axis.

4. The terminal position assurance system as set forth in claim 1, wherein said terminal mating portion is female forming a generally rectangular cross section adapted to receive a male blade terminal.

5. The terminal position assurance system as set forth in claim 4 wherein said terminal mating portion includes a base wall having two edges each extending along a line parallel to the terminal insertion direction, two side walls bent at the base wall edges extending in the same direction and perpendicular to the base and two top walls bent from the side walls extending toward each other where said bendable tab extends from one of said top walls.

6. A terminal position assurance system in an electrical connector which includes a dielectric housing having a terminal-receiving passage into which a terminal having a forward end is inserted in an insertion direction with its forward end first to a fully inserted position, a latch surface adjacent the passage facing in said insertion direction, and a bendable tab on the terminal and adapted to be bent against the latch surface, wherein the improvement comprises said bendable tab located at said forward end and being structured to be bent about an axis generally parallel to said insertion direction to move an edge portion of the tab to a position over the latch surface when the terminal is in its fully inserted position.

7. The terminal position assurance system as set forth in claim 6, wherein said latch surface is generally flat and said tab is generally planar.

8. The terminal position assurance system as set forth in claim 7, wherein said tab had an edge generally perpendicular to said axis and adapted for lockingly engaging the latch surface when the tab is bent about the axis.

9. A method of ensuring proper positioning of a female terminal having a generally rectangular cross section defining a terminal mating cavity having a longitudinal axis in a dielectric housing of an electrical connector, the housing having a terminal-receiving passage into which the terminal is inserted in an insertion direction to a fully inserted position, comprising the steps of:

providing a latch surface on the housing adjacent the passage and facing in said insertion direction;

providing a bendable tab on the terminal, the tab being bendable about an axis generally parallel to said insertion direction from a first position aligned with said passage to a second position over the latch surface;

inserting the terminal into the passage in said insertion direction to said fully inserted position;

inserting an elongated blade like tool into said terminal mating cavity; and bending said tab from said first position to said second position by moving the tool about its longitudinal axis generally while the tool axis is congruent with the longitudinal axis of the terminal mating cavity.

* * * * *